US010773365B2

(12) United States Patent
Marxkors et al.

(10) Patent No.: US 10,773,365 B2
(45) Date of Patent: Sep. 15, 2020

(54) INSTALLATION TOOL FOR A WIRE THREAD INSERT HAVING AN INSTALLATION PIN THAT CAN BE BENT BACK, AND INSTALLATION METHOD

(71) Applicant: Böllhoff Verbindungstechnik GmbH, Bielefeld (DE)

(72) Inventors: Andreas Marxkors, Hövelhof (DE); Holger Thommes, Strohn (DE); Dennis Henke, Rheda-Wiedenbrück (DE)

(73) Assignee: Böllhoff Verbindungstechnik GmbH (DE)

( * ) Notice: Subject to any disclaimer, the term of this patent is extended or adjusted under 35 U.S.C. 154(b) by 263 days.

(21) Appl. No.: 15/529,203

(22) PCT Filed: Nov. 17, 2015

(86) PCT No.: PCT/EP2015/076755
§ 371 (c)(1),
(2) Date: May 24, 2017

(87) PCT Pub. No.: WO2016/083188
PCT Pub. Date: Jun. 2, 2016

(65) Prior Publication Data

US 2017/0361440 A1 Dec. 21, 2017

(30) Foreign Application Priority Data

Nov. 24, 2014 (DE) ..... 10 2014 223 905

(51) Int. Cl.
*B25B 27/14* (2006.01)

(52) U.S. Cl.
CPC ..... *B25B 27/143* (2013.01)

(58) Field of Classification Search
CPC ..... B25B 27/143
See application file for complete search history.

(56) References Cited

U.S. PATENT DOCUMENTS 2,363,789 A 11/1944 Haas
3,348,293 A * 10/1967 Newton ..... B25B 27/143 29/240.5

(Continued)

FOREIGN PATENT DOCUMENTS

CN 103282164 A 9/2013
DE 1 016 066 B 9/1957

(Continued)

OTHER PUBLICATIONS

English Translation of Written Opinion for PCT/EP2015/076755; dated Mar. 1, 2016; 5 pages.

(Continued)

*Primary Examiner* — Christopher M Koehler
(74) *Attorney, Agent, or Firm* — Barclay Damon LLP

(57) ABSTRACT

The inventive installation tools are adapted to a wire thread insert comprising a cylindrical coil with a plurality of helically wound windings of a wire and a driving tang with a moving notch protruding into an interior of the coil via a bending portion. The installation tool has the following features: a rotatable mounting spindle with a driving end for rotating the installation spindle and a functional end for installing the wire thread insert, wherein the functional end comprises at least one turn that is length-reduced in the circumferential direction and that has, at a first end, a driving edge for engagement into a moving notch of the wire thread insert and, at a second end, a bend-up-shoulder for bending the driving tang of the wire thread insert radially outwardly.

10 Claims, 6 Drawing Sheets

(56) References Cited

U.S. PATENT DOCUMENTS

Figure 1:
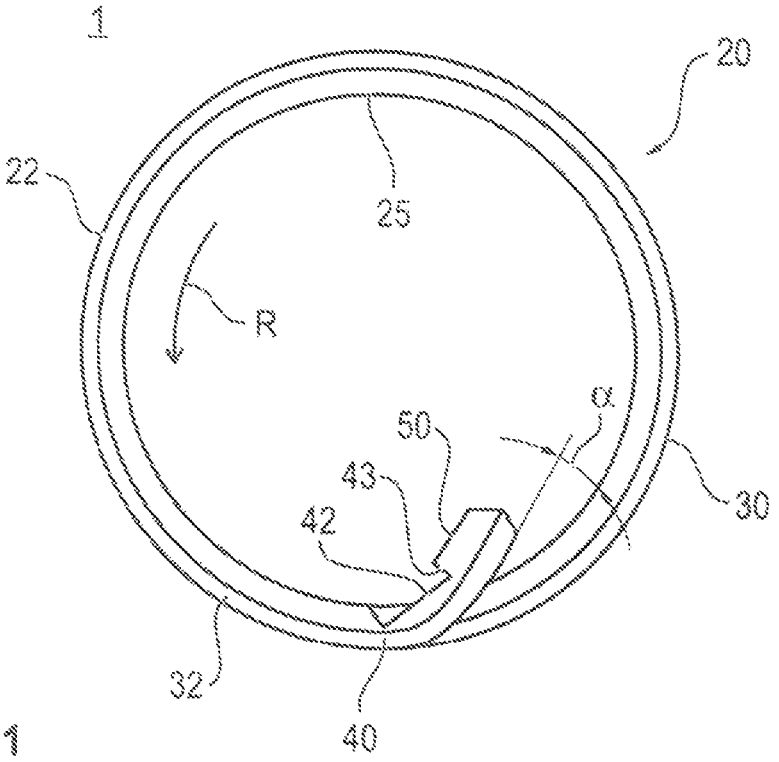

| | | | | |
|---|---|---|---|---|
| 4,645,398 | A * | 2/1987 | Cosenza | F16B 37/12 411/438 |
| 5,212,865 | A * | 5/1993 | Davis | B25B 27/143 29/240.5 |
| 6,146,073 | A | 11/2000 | Kobusch | |
| 8,850,680 | B2 * | 10/2014 | Marxkors | F16B 37/12 29/240.5 |
| 9,719,546 | B2 | 8/2017 | Thommes et al. | |
| 2003/0051584 | A1 * | 3/2003 | Giannakakos | B25B 27/143 81/436 |
| 2007/0245533 | A1 * | 10/2007 | Szewc | B25B 27/143 29/240.5 |
| 2009/0293248 | A1 * | 12/2009 | Sato | B25B 27/143 29/240.5 |
| 2013/0276287 | A1 * | 10/2013 | Thommes | B21F 3/02 29/428 |

FOREIGN PATENT DOCUMENTS

| | | | |
|---|---|---|---|
| DE | 3807439 | A1 | 9/1989 |
| DE | 10 2010 050 735 | A1 | 5/2012 |
| EP | 0 140 812 | A1 | 5/1985 |
| EP | 0 157 715 | A2 | 10/1985 |
| EP | 0 228 981 | B1 | 1/1991 |
| EP | 0 983 445 | B1 | 3/2002 |
| IL | 74380 | A | 10/1989 |
| JP | 2015-71216 | | 4/2015 |

OTHER PUBLICATIONS

Chinese Office Action for CN 201580071341.0; dated Dec. 17, 2018; 8 pages.

International Search Report and Written Opinion for PCT/EP2015/076755; dated Mar. 1, 2016; 12 pages.

English Translation of International Search Report; dated Mar. 1, 2016; 2 pages.

* cited by examiner

INSTALLATION TOOL FOR A WIRE THREAD INSERT HAVING AN INSTALLATION PIN THAT CAN BE BENT BACK, AND INSTALLATION METHOD

CROSS-REFERENCE TO RELATED APPLICATIONS

This application is a national stage application pursuant to 35 U.S.C. § 371 of International Application No. PCT/EP2015/076755, filed Nov. 17, 2015, which claims priority upon German Patent Application No. 10 2014 223 905.2, filed Nov. 24, 2014, the entire contents of each application herein being incorporated by reference.

FIELD OF THE INVENTION

The present invention is related to an installation tool for a wire thread insert for mounting into a receiving thread of a component as well as an installation method for this wire thread insert in the component with receiving thread.

BACKGROUND OF THE INVENTION

In the prior art, different wire thread inserts for mounting into a receiving thread of a component are known. They are for example described in U.S. Pat. No. 2,363,789, EP-A-0 140 812 and EP-A-0 157 715. Consistently, the outer diameter of the cylindrical walls of the wire thread insert has to be chosen somewhat larger as the outer diameter of the receiving thread of the component. Therefore, the mounting of the wire thread insert into the receiving thread of the component has to occur by means of a diameter reduction of the wire thread insert. In this way it is ensured that a tight fit of the wire thread insert is achieved by means of the elastic re-deformation of the wire thread insert after installation in the receiving thread.

For facilitating the driving in of the wire thread insert into the receiving thread, a half winding at the end of the cylindrical coil of the wire thread insert is retracted or moved radially into the inside in known manner (EP-B1-0 228 981). The smallest outer diameter of the retracted section of the wire thread insert shall be almost equal to or somewhat larger as the corresponding outer diameter of the receiving thread in the component. Further, at this known wire thread insert, the wire cross-section is tapered at the end to facilitate the driving in of the wire thread insert into the receiving thread and to avoid damages of the thread bore in the component.

Different embodiments of wire thread inserts are also disclosed in EP-B1-0 983 445. A wire thread insert consists of a cylindrical coil with a plurality of helically wound windings. A first winding of this cylindrical coil leads to a mounting tang protruding linearly radially into the cylindrical coil. By means of a suitable installation tool, this mounting tang is grasped and thereby, the wire thread insert is screwed into the receiving thread of the component. After the installation has been completed, the mounting tang is removed by breaking-off the mounting tang in the first winding with the aid of a predetermined breaking point. In this way, a receiving thread with a continuously screwable wire thread insert results.

DE 1 016 066 B discloses a locking screw at which a wire thread insert is fastenable. For this purpose, the locking screw has a transverse slot at a front end in which a radially inwardly bent driving tang of the wire thread insert can be received. To be able to remove the locking screw from the wire thread insert, an inlying channel is provided in the locking screw which ends at the transverse slot. A pin can be inserted into this channel by means of which the driving tang can be pressed out of the transverse slot. At this, the driving tang is neither excessively deflected, broken or permanently deformed. Subsequently, the locking screw can be removed from the wire thread insert.

DE 10 2010 050 735 describes different alternatives of a wire thread insert with redressable but not removable tang. The tangs serve for installing the wire thread insert in a component opening with thread. After installation, the tang is redressed into the circumferential shape of the wire thread insert without obstructing later the screwing-in of a threaded bolt into the wire thread insert. The redressing occurs by means of an installation tool having a compressing blade. The compressing blade exerts a force onto the free front end of the tang and redresses it thereby. For facilitating the redressing, a bending portion between coil and tang of the wire thread insert comprises a tapered notch or a moving notch. The moving notch serves at the same time as tapering in the bending portion and as installation aid for the wire thread insert into the component opening.

Starting from the known wire thread inserts with redressable and not removable tang, it is the technical object of the present invention to provide an alternative and technically simple and resilient installation tool and an alternative installation method by means of which the wire thread insert is installable in a component opening with thread.

SUMMARY OF THE INVENTION

The above object is solved by the installation tool and the installation method according to the appending claims. Advantageous embodiments and developments of the present invention result from the appending claims, the description, as well as the accompanying drawings.

The inventive installation tools are adapted to a wire thread insert having a cylindrical coil with a plurality of helically wound windings of a wire. A first winding comprises a driving tang with moving notch protruding into an interior of the coil via a bending portion. The driving tang protrudes radially inwardly with respect to the coil and encloses an angle <90° with a second winding of the coil extending in the course of direction of the driving tang.

According to a first alternative, the installation tool comprises the following features: a rotatable mounting spindle with a driving end for rotating the mounting spindle and a functional end for installing the wire thread insert, wherein the functional end comprises at least one turn which is reduced in length in circumferential direction and which has a driving edge at a first end for engagement into a moving notch of the wire thread insert and a bend-up-shoulder at a second end for bending the driving tang of the wire thread insert radially outwardly.

The installation tool comprises a known mounting spindle on the functional end of which the wire thread insert to be mounted can be fastened rotation-proof so that it can be screwed into a component opening with thread by rotating the mounting spindle. The rotation of the mounting spindle occurs by means of the driving end which is moved manually or by means of a motorized drive. On the functional end of the mounting spindle, the wire thread insert is fastenable rotation-proof in a rotation direction of the mounting spindle. In this context and on the one hand, it is preferred that the functional end comprises an appropriate outer thread so that the wire thread insert can be screwed onto this outer thread. According to another preferred embodiment, the functional end has an outer diameter which is smaller as the inner diameter of the wire thread insert. Due to this dimensioning it is possible to plug the wire thread insert onto the functional end of the installation tool.

At the functional end, which is arranged oppositely to the driving end of the mounting spindle, a turn is arranged which is reduced in its circumferential length. This means that at the functional end of the mounting spindle facing away from the driving end seen in longitudinal direction of the mounting spindle at least a last turn is reduced in its length such that this last turn does not extend over a rotation angle of 360° around the longitudinal axis of the mounting spindle. Contrary to this, the length-reduced turn extends in circumferential direction preferably over a length which is defined by a rotation angle of ≤270°, preferably ≤180°, around the longitudinal axis of the mounting spindle.

While the in circumferential direction at least one length-reduced turn forms a radial outer side for the abutment at the wire thread insert to be installed, the two opposing ends of the length reduced turn are formed as functional elements. At one end preferably the driving edge is present which is formed by a radial inner and a radial outer leg. The radial inner and the radial outer leg enclose preferably an angle <90°.

At the other end of the at least one length-reduced turn, the bend-up-shoulder is arranged. The bend-up-shoulder comprises a web inclined radially inwardly and opposite to a drive-in direction of the mounting spindle which encloses with a radial outer edge of the mounting spindle preferably an angle <90°. Due to its preferred acute-angled embodiment, the driving edge forms a blade-like guiding in drive-in direction of the wire thread insert which engages in the moving notch of the wire thread insert in a form-fit manner due to its arrangement. This form-fit engagement ensures a rotation-proof connection between mounting spindle and wire thread insert in drive-in direction or installation direction of the wire thread insert in the component opening. The bend-up-shoulder acts, on the contrary, only at a rotating of the mounting spindle against the installation direction, thus if the mounting spindle is removed rotatingly from the wire thread insert. Due to its preferred angled embodiment, the driving tang enters into an angle at the screwing-out of the mounting spindle which is formed by the bend-up-shoulder and the radially inner wall of the component opening. Upon further rotating, the bend-up-shoulder presses the driving tang against the radially inner component opening so that the driving tang is redressed permanently into the outer contour of the wire thread insert. At this, the bend-up-shoulder slides along the driving tang against the drive-in direction of the wire thread insert.

To support this redressing of the driving tang advantageously, the bend-up-shoulder is formed curvilinear according to a preferred embodiment of the present invention. Accordingly, the bend-up-shoulder comprises with respect to the installation spindle in its course radially inwardly an increasing curvature. Further, it is preferred that the bend-up-shoulder is connected integrally to the driving edge by means of the at least one length-reduced turn.

The present invention comprises a further alternative of the installation tool for the wire thread insert. The wire thread insert consists of a cylindrical coil with a plurality of helically wound windings of a wire in which a first winding comprises a driving tang with moving notch protruding into an interior of the coil via a bending portion. The installation tool comprises the following features: a rotatable mounting spindle with a driving end for rotating the mounting spindle and with a functional end for installing the wire thread insert in a component opening, in which the functional end comprises a first threaded portion having a first core diameter and a second threaded portion having a second core diameter, wherein the first threaded portion is arranged between the driving end and the second threaded portion, wherein the second core diameter is larger as the first core diameter and wherein the functional end comprises a recess in a turn which forms an undercut for the driving tang of the wire thread insert in drive-in direction of the wire thread insert.

The second inventive alternative of the installation tool is characterized by a functional end with two threaded portions adjacent to each other. The first threaded portion serves substantially for receiving the wire thread insert to be installed. If the wire thread insert is arranged in this threaded portion it is preferably installed in a component opening of a component. The second threaded portion having a larger core diameter as the first threaded portion is arranged such that this second threaded portion has to be screwed through the installed wire thread insert at the removing of the mounting spindle from the installed wire thread insert. Due to the larger core diameter of the second threaded portion which forces its way through the wire thread insert at the screwing out of the mounting spindle out of the wire thread insert, the driving tang with moving notch is redressed radially outwardly into the circumferential outer contour of the wire thread insert. As preferably different mechanical tension conditions are superimposed in the bending portion, the driving tang is redressed permanently into the circumferential contour of the wire thread insert. Preferably, and after the redressing, the driving tang is arranged in the outer contour of the wire thread insert or in the thread of the mounting opening of the wire thread insert precisely tailored or true to size or true to gauge.

For holding the wire thread insert which is spindled or plugged onto the functional end during the mounting rotation-proof, the above-mentioned recess is provided. This recess is preferably arranged in the first threaded portion, preferably within a rotation angle of 270° starting at or adjacent to the second threaded portion. The radially inwardly bent driving tang with moving notch snaps into this recess at the spindling or plugging of the wire thread insert onto the functional end. With the arrangement of the recess spaced from the second threaded portion it is guaranteed that only at the de-spindling of the mounting spindle out of the installed wire thread insert the second threaded portion in combination with the radially inner wall of the component opening creates sufficient mechanical tensions in the driving tang which redress the driving tang permanently.

It is further preferred that the second core diameter is at least 0.1% larger as the first core diameter, preferably in a range of 0.1% to 2% larger as the first core diameter. According to a further preferred embodiment of the present alternative of the installation tool, the second threaded portion extends over a rotation angle of at least 180° around the longitudinal axis of the mounting spindle.

The present invention comprises further an installation method of the wire thread insert with redressable, not removable driving tang and a moving notch by means of an installation tool in a receiving thread of a component, which comprises the following steps: spindling or plugging the wire thread insert onto a functional end of a mounting spindle of the installation tool such that the moving notch couples in a form-fit manner to a driving edge or a radial recess of the installation tool and connects the wire thread insert rotation-proof with the installation tool, driving-in of the wire thread insert into the receiving thread by rotating the mounting spindle in a first rotation direction, redressing the driving tang into the receiving thread by rotating the mounting spindle in a second rotation direction and de-spindling or removing the mounting spindle from the wire thread insert with redressed driving tang.

As part of the installation method it is further preferred that a radial redressing of the driving tang occurs by means of a bend-up-shoulder or a second threaded portion with enlarged core diameter compared to a first threaded portion at the functional end of the mounting spindle.

SHORT DESCRIPTION OF THE ACCOMPANYING DRAWINGS

Figure 2:
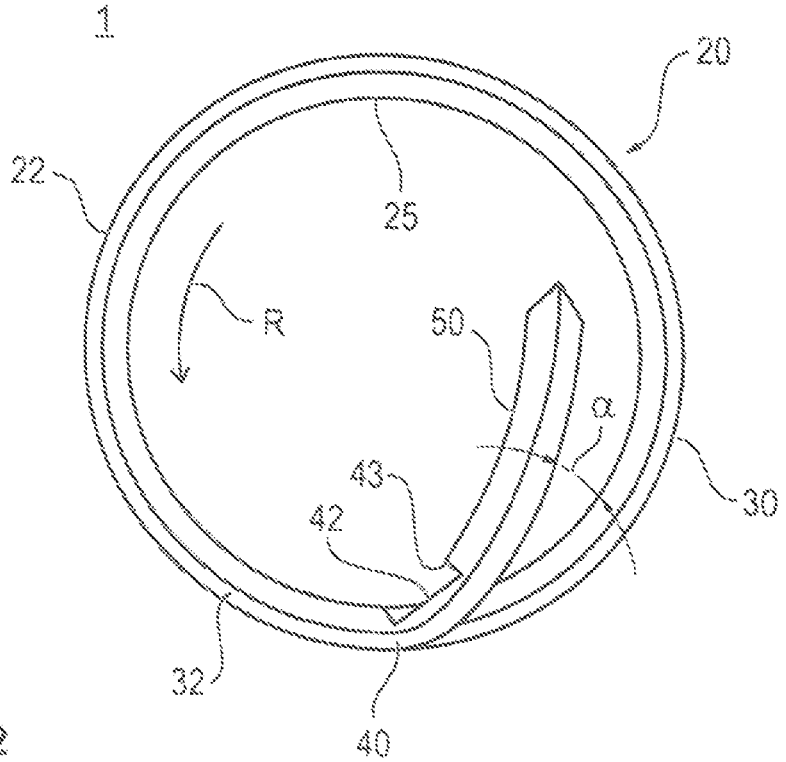
Figure 3:
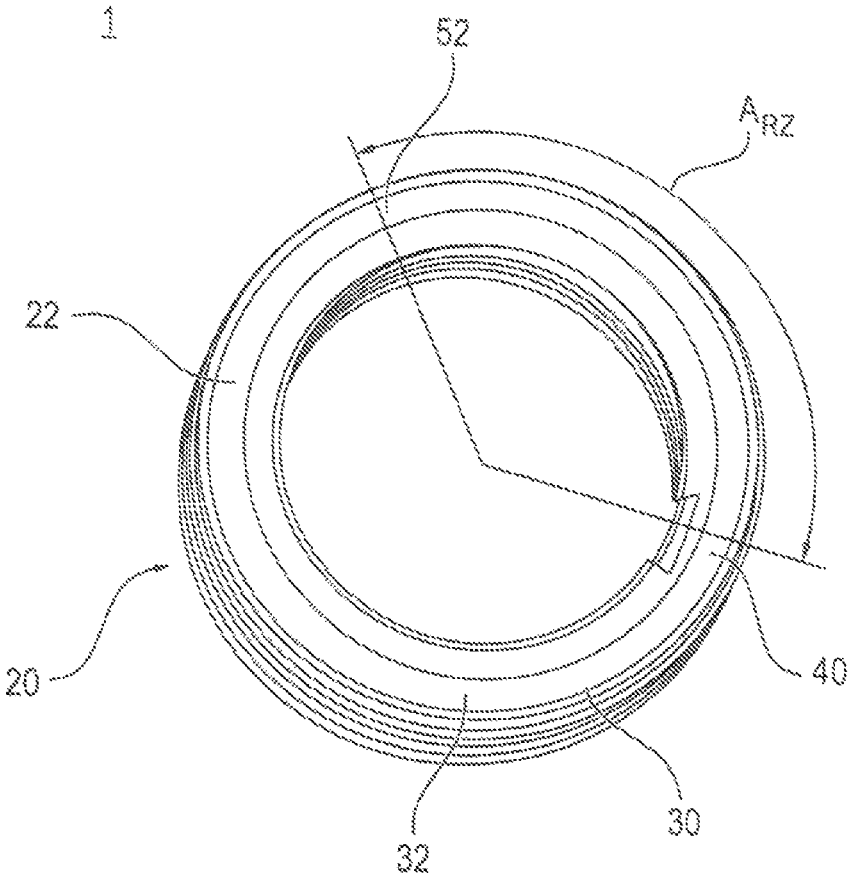
Figure 4:
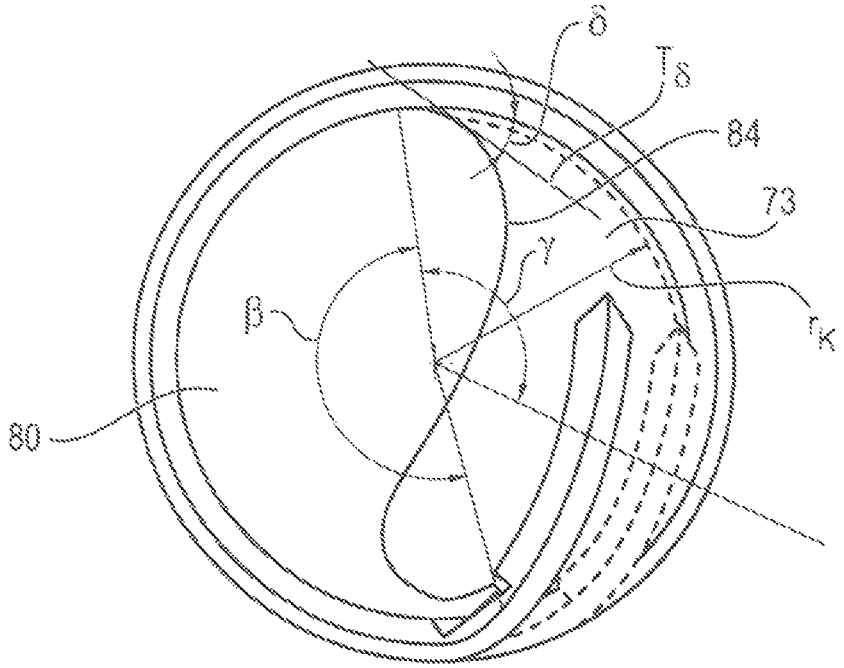
Figure 5:
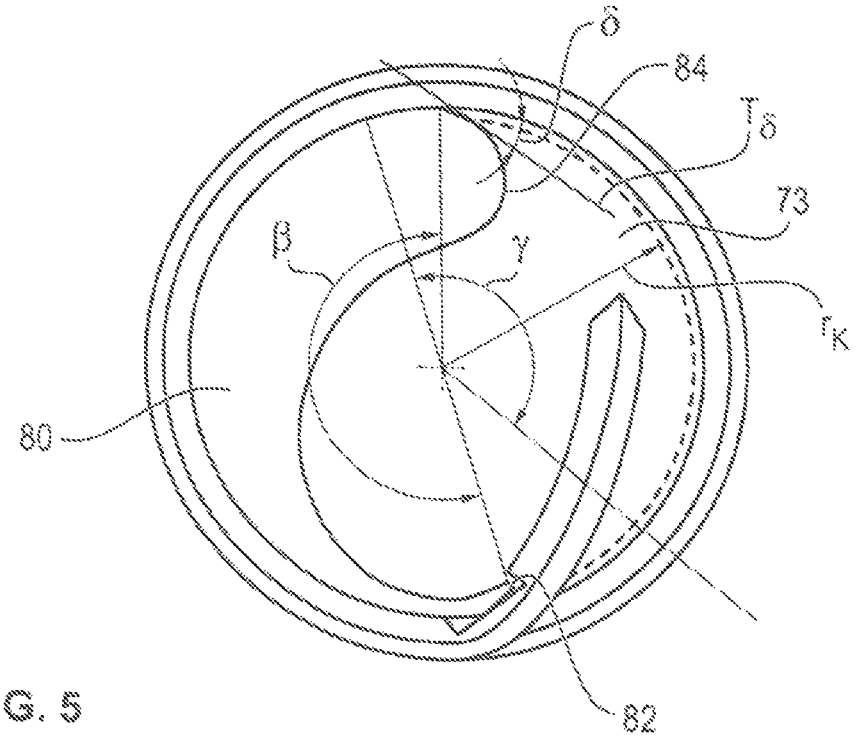
Figure 6:
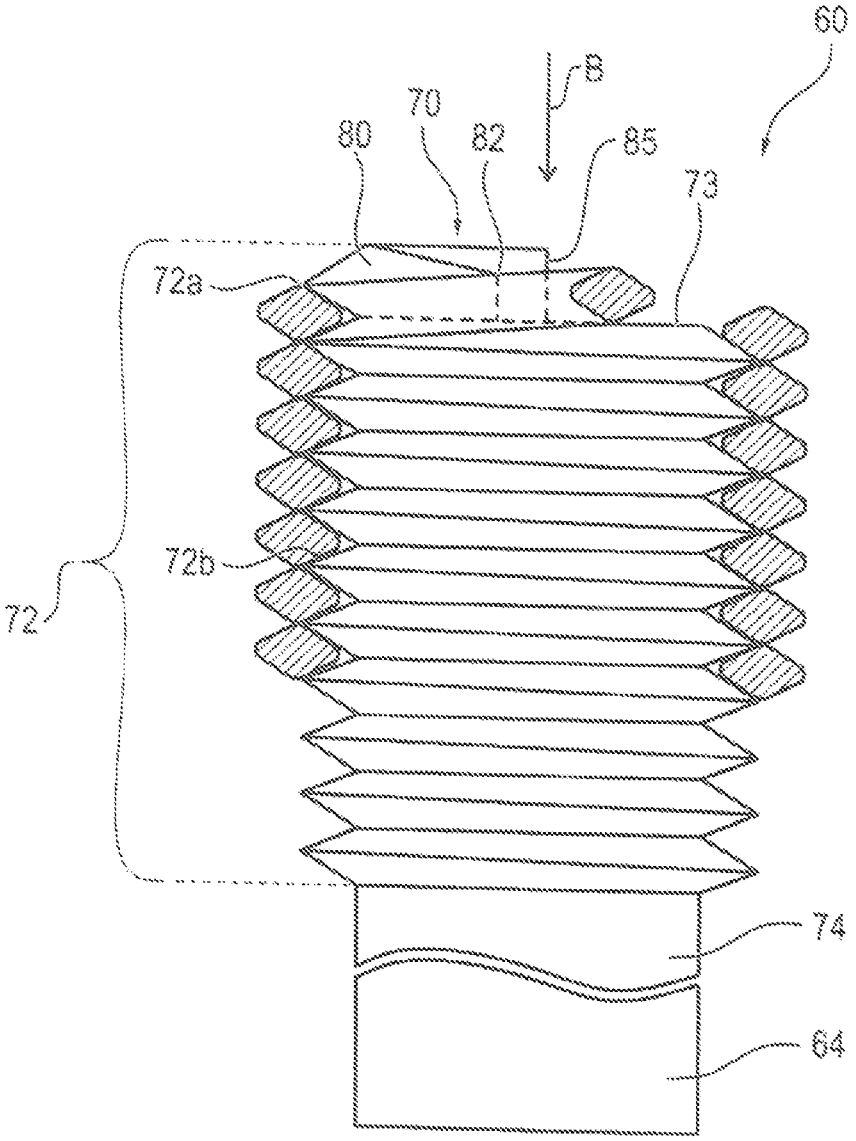
Figure 7:
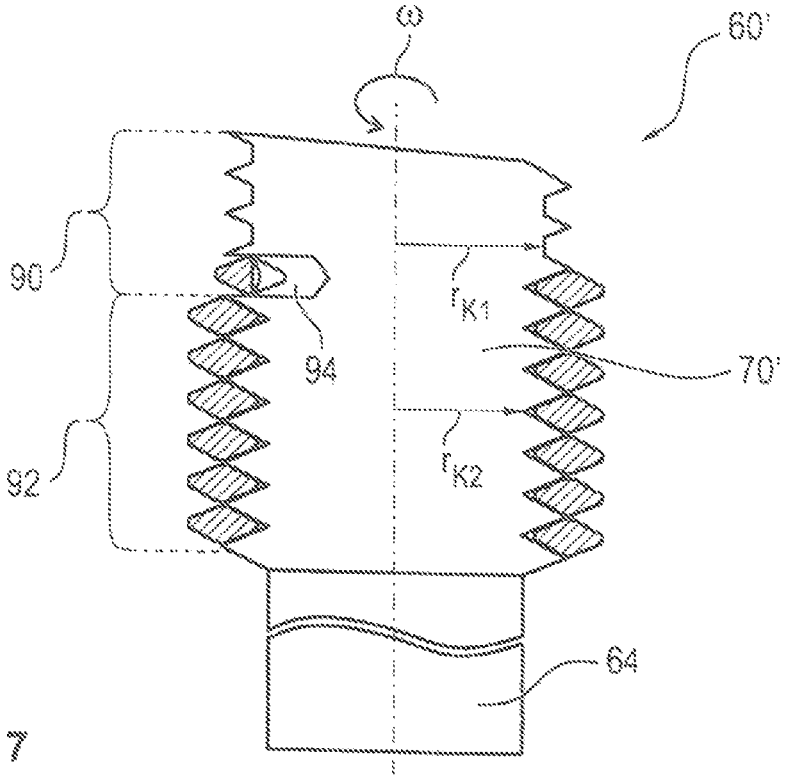
Figure 8:
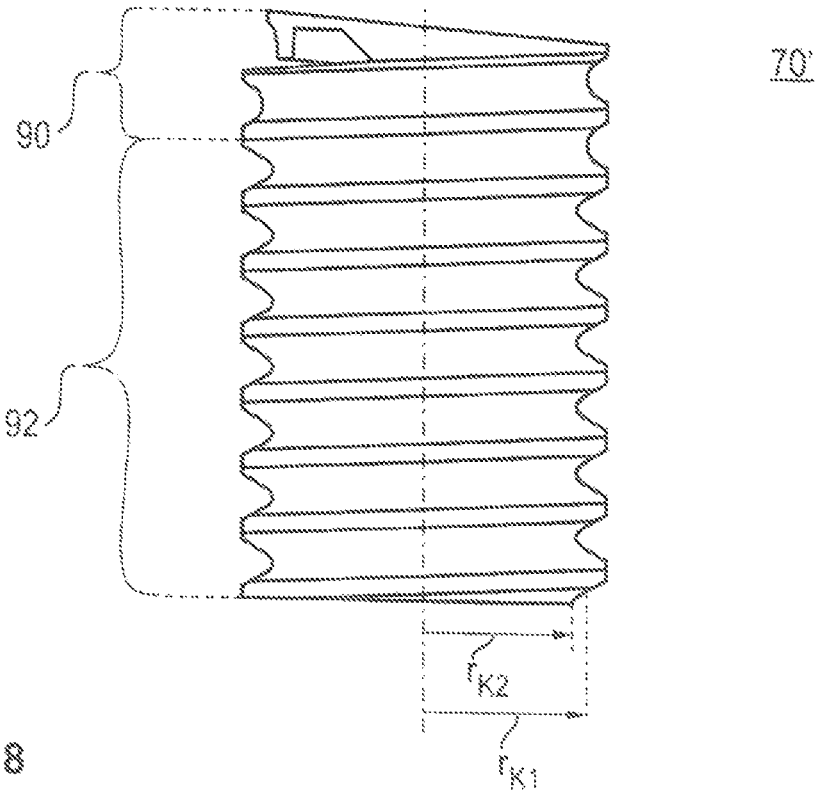
Figure 9:
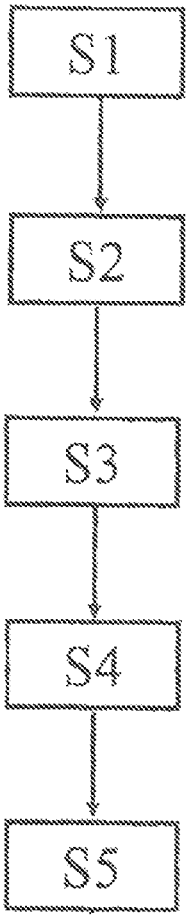

The different/preferred embodiments of the present invention are explained in detail with reference to the accompanying drawings. It shows:

FIG. 1 a front end view of a preferred embodiment of the wire thread insert with redressable driving tang and moving notch, FIG. 2 a front end view of a further preferred embodiment of a wire thread insert with redressable driving tang and moving notch, FIG. 3 a perspective view of a preferred wire thread insert with redressed driving tang and with moving notch, FIG. 4 a front end view of a preferred first alternative of the inventive installation tool, FIG. 5 a front end view of a further preferred first alternative of the installation tool, FIG. 6 a cross-sectional side view of the preferred first alternative of the installation tool, FIG. 7 a cross-sectional side view of a preferred second alternative of the installation tool, FIG. 8 a schematic view of the two threaded portions of the preferred second alternative of the installation tool, and FIG. 9 a flowchart of a preferred embodiment of the inventive installation method of the wire thread insert into an inner thread of a component opening of a component with an installation tool.

DETAILED DESCRIPTION OF THE PREFERRED EMBODIMENTS

The present invention is related to different alternatives of an installation tool for mounting or installing a wire thread insert 1 into a component opening with inner thread of a component. The usage and dimensioning of wire thread inserts 1 is known in the prior art.

The inventive wire thread insert 1 is wound of a wire of known material and known cross-sectional shape. With reference to FIGS. 1 to 3, the wire thread insert 1 comprises a cylindrical coil 20 consisting of a plurality of helically wound windings 30. The coil 20 has a first end 22 and a second end 24. A driving tang 50 with moving notch 42 is arranged at the first end 22 of the cylindrical coil 20 which protrudes in a radial plane of the cylindrical coil 20 into the interior of the cylindrical coil 20.

The driving tang 50 is connected to a first winding 32 of the cylindrical coil 20 at its first end 22 via a bending portion 40. The driving tang 50 does not protrude linearly radially into the interior of the cylindrical coil 20, as can be seen based on FIGS. 1 and 2. Instead, the driving tang 50 has almost the shape of a circular arc. The circular arc of the driving tang 50 has preferably the same radius or a larger radius as the cylindrical coil 20 so that the driving tang 50 is permanently redressable from the interior of the cylindrical coil 20 into the course of the first winding 32. It is also preferred to form the circular arc of the driving tang 50 with a radius which differs ±1% from the radius of the cylindrical coil 20 at the maximum. Further, the driving tang 50 encloses an angle $\alpha$ with the circumferential contour of the wire thread insert. Preferably, the angle $\alpha$ is smaller than 90° and forms an acute angle. It has turned out that when the driving tang 50 has a length of 0.2 U to 0.4 U, it can be redressed advantageously into the circumferential contour of the wire thread insert 1 from an angle $\alpha$ of $5° \leq \alpha \leq 50°$, preferably $1° \leq \alpha \leq 35°$. At this, it has an advantageous effect that the driving tang 50 abuts with its length at the installation tool (see below) by means of friction. Thereby, a multi-axial mechanical tension condition is transferred into the bending portion 40 which ensures the permanent redressing of the driving tang 50. In the case of a driving tang 50 with a preferred length $L_Z$ of $0.05\ U \leq L_Z \leq 0.1\ U$, the driving tang 50 is preferably arranged in an angle range of $5° \leq \alpha \leq 45°$, preferably $5° \leq \alpha \leq 30°$. The dimension U designates the circumference of the wire thread insert 1, which can be calculated from the radius or the diameter of the wire thread insert 1.

The bending portion 40 has the function to connect the driving tang 50 with the remaining of the wire thread insert 1 in a bendable and tensile-rigid manner. Thereby it is ensured that during installing the wire thread insert 1 into a receiving thread A of a component B a sufficient high torque can be applied onto the wire thread insert 1 by means of the driving tang 50. Based on this constructive configuration the wire thread insert 1 can be drawn into the receiving thread A by means of the driving tang 50 without that the driving tang 50 breaks. To transmit the required torque onto the wire thread insert for the driving in of the wire thread insert into the component opening, the wire thread insert comprises the moving notch 42. The moving notch 42 consists of a radial recess at a radial inner side of the bending portion 40 in drive-in direction R (see FIGS. 1, 2). The moving notch 42 comprises an undercut 43 in drive-in direction R which allows a rotation-proof coupling (in drive-in direction R) of an installation tool (see below) to the moving notch 42 and a rotating of the wire thread insert 1 as well. Preferably, the moving notch 42 is positioned such that the undercut 43 is arranged within the circumferential contour of the wire thread insert 1. Preferably, the undercut 43 protrudes radially inwardly beyond the inner edge 25 of the wire thread insert 1. In this way, a coupling between installation tool and wire thread insert is supported.

Further, the bending portion 40 ensures that the driving tang 50 is permanently redressable into the receiving thread A of the component B or generally into the course of the first winding 32. To this end, the bending portion 40 has the same mechanical, thermal, chemical and geometric characteristics as the wire of the cylindrical coil 20. By means of a suitable installation tool (see below) the driving tang 50 is bent in a radial direction out of the interior of the cylindrical coil 20 at the redressing without that the driving tang 50 returns thereafter elastically into the interior of the cylindrical coil 20. This condition is shown in FIG. 4.

For facilitating the redressing of the driving tang 50 into the receiving thread A or into the course of the first winding 32, preferably the wire in the bending portion 40 is modified in its bending characteristics compared to the wire of the cylindrical coil 20. This modification of the bending portion 40 is created chemically, geometrically, formally, chemically or in any other manner according to different embodiments of the present invention.

According to the preferred embodiment shown in FIGS. 2 and 3, the wire of the bending portion 40 is tapered in its cross-section compared to the wire of the cylindrical coil 20.

This is realized by means of the moving notch 42. The tapering or notch 42 is formed such that a low notch factor at the bending of the driving tang 50 is created and thus the driving tang 50 does not break during the bending. The moving notch 42 is arranged at the radial inner side of the bending portion 40. The moving notch is formed and positioned such that it can enter into a driving blade or edge which is present in the contour of the drive-in tool for driving the wire thread insert 1 into a receiving thread and locks there in a form-fit manner. As can be seen in FIGS. 2 and 3, the upstream side of the moving notch 42 in drive-in direction of the wire thread insert 1 forms an undercut at which the driving blade abuts in a form-fit manner. The radially inwardly bent driving tang 50 supports the engagement of the driving blade or edge in the moving notch 42 because at least the side of the moving notch 42 being upstream in screw-in or drive-in direction protrudes beyond the circumferential contour radially inwardly into an interior of the wire thread insert 1. Thus, the moving notch 42 realizes two functions at the same time. On the one hand, it makes the engagement and locking of the driving blade or edge of an installation tool for the wire thread insert 1 possible. On the other hand, it provides a tapering of the bending portion 40 which supports a bending of the driving tang 50 into the receiving thread of the component.

For reducing the mechanical moment of resistance or the elastic moment of restoration of the wire in the bending portion 40, for example from up to 2.000 MPa to about 400 MPa, the bending portion is mechanically processed. Suitable methods comprise the notching, milling, punching, forging, grinding, polishing, cold punching, pickling, lapping, to reduce the cross-section of the bending portion 40. At the same time, it has to be ensured that the corrosion characteristics in the bending portion 40 are restored after the processing.

The preferred wire thread insert 1 can be characterized in summary as follows: wire thread insert 1 for mounting in a receiving thread of a component which comprises the following features: a cylindrical coil 20 consisting of a plurality of helically wound windings 30 of a wire comprising a first 22 and a second end 24, wherein a first winding 32 provided at the first end 22 comprises a driving tang 50 with a moving notch 42 protruding into an interior 26 of the coil 20 via a bending portion 40, and wherein the driving tang 50 is connected to the first winding 32 inseparably, is redressable by means of the bending portion 40 from the interior 26 of the coil 20 and the wire thread insert 1 is installable by means of the moving notch 42 and the driving tang 50. Further preferred, the driving tang 50 of the wire thread insert 1 is redressable into the receiving thread A of the component B permanently. It is further preferred that the driving tang 50 is a circular arc, the tang radius of which is almost equal to a radius of the first winding 32 of the cylindrical coil 20. For further constructive details of the wire thread insert, it is referred to DE 10 2010 050 735, which is hereby incorporated as reference.

Based on the above-described embodiment of the bending portion 40 and the shape of the driving tang 50, the driving tang 50 of a wire thread insert 1 installed in a receiving thread A of the component B can be bent out of the interior of the cylindrical coil 20 so that the receiving thread A with the wire thread insert 1 is true to gauge. This means that a screw or a thread plug gauge can be screwed into the receiving thread A with the wire thread insert 1 with a negligible low additional torque or frictional moment due to the redressed driving tang 50. The accuracy to gauge of the receiving thread A with the wire thread insert 1 can be demonstrated in that a manual driving-in of the thread plug gauge according to tolerance class 6H, preferably of tolerance class 5H, is ensured.

According to different embodiments of the present invention, the driving tang 50 is formed with different lengths (see above). In the redressed condition according to FIG. 3, the driving tang 50 extends over a circular arc $A_{RZ}$ with a length $L_Z$ of $0.05\ U \leq L_Z \leq 0.4\ U$, preferably $0.2\ U \leq L_Z \leq 0.4\ U$ or $0.05\ U \leq L_Z \leq 0.1\ U$. At this, U denotes the outer circumference of the wire thread insert. The length $L_Z$ of the driving tang is measured always starting at the bending portion 42 to the free end of the driving tang 50.

FIGS. 1 and 2 show two preferred embodiments of a wire thread insert 1 which are installed in a component opening by means of the installation tools described below in greater detail. FIG. 3 shows schematically a wire thread insert 1 with redressed driving tang 50 as it would be arranged installed in a component opening.

The wire thread insert 1 is mounted into the component opening with thread (not shown) by means of an installation tool 60; 60'. Two alternatively preferred constructions of the installation tool 60; 60' are schematically shown in FIGS. 4-6 and 7-8. At the description of the alternative installation tool 60; 60', the same constructive details are denoted with the same reference signs. Further, descriptions of these same constructive details apply equally for both alternatives of the installation tool 60; 60' even if they have been discussed only in combination with one alternative.

The installation tool 60; 60' comprise always a rotatable mounting spindle 62 with a driving end 64 and a functional end 70; 70'. The mounting spindle 62 is rotatable by means of the driving end 64 manually or mechanically with a respective, for example electro-motoric, drive (not shown). First of all, the wire thread insert 1 is fastened or arranged (step S1) on the functional end 70; 70'. For this purpose, the wire thread insert 1 is taken between thumb and forefinger and the functional end 70; 70' of the mounting spindle 62 is screwed into the wire thread insert 1. At this, the functional end 70; 70' enters at the front end of the wire thread insert 1 which is arranged opposite to the front end of the wire thread insert 1 with driving tang 50. Depending on whether the wire thread insert 1 comprises a clockwise or counterclockwise thread, the mounting spindle 62 is rotated clockwise or counterclockwise.

According to another preferred embodiment of the present invention, the functional end 70; 70' of the mounting spindle 62 is provided with a diameter which is smaller as an inner diameter of the wire thread insert 1. In this case, the wire thread insert 1 is plugged onto the functional end 70; 70' to fasten or arrange it on or at the mounting spindle 62. Although in this case the accuracy to gauge of the mounted wire thread insert is affected, a driving-in of a screw into the installed wire thread insert is possible.

A preferred embodiment of the first alternative of the installation tool 60 is shown in FIGS. 4-6. The functional end 70 of the mounting spindle 62 comprises a threaded section 72 formed compatible to the wire thread insert 1. The threaded section 72 extends, beginning at the free end of the mounting spindle 62, preferably over at least a partial length of the functional end 70. This partial length corresponds according to an embodiment of the present invention at least to an axial length of the wire thread insert 1 so that it can be spindled onto the functional end 70 in its full length. It is also preferred to form the threaded section 72 shorter. In this case, the threaded section 72 is followed in fastening direction B of the wire thread insert 1 on the functional end 70 by a receiving portion 74 having a smaller diameter compared to the threaded section 72. This receiving portion 74 allows a ramping and later supporting and guiding of the wire thread insert 1 without that the function of the threaded section 72 is restricted.

The threaded section 72 comprises a circumferential turn which extends coil-like around the mounting spindle 62 at the functional end 70. The turn is formed by two radially outwardly protruding flanks arranged opposite to each other, between which the coil-like bent wire of the wire thread insert 1 is guided. Near the free end of the functional end 70, which is facing away from the driving end 64, the turn 72 is open (aperture 73). Within this aperture 73, the wire of the wire thread insert 1 is not supported or guided on two sides by flanks of the turn over the length portion of a rotation angle $\gamma$ of preferably at least 360°. Due to this aperture 73 or the at least on one-side flank less length portion defined by the angle $\gamma$ and the diameter of the functional end 70, the functional end 70 comprises a length-reduced first turn 72*a* and a second turn 72*b*.

The aperture 73 is formed by a front end axial extension 80 of the functional end 70 which protrudes opposite to the fastening direction B of the wire thread insert 1 from the front end of the functional end 70. The extension 80 extends only over a part of the front end, as can be seen in FIGS. 4 and 5. Due to this, a part of the front end face of the functional end 70 is set back behind the extension 80 whereby the aperture 73 is created.

The extension 80 is defined along a circumferential length by the length-reduced first turn 72*a*. Preferably, the length-reduced first turn 72*a* and thus the one side of the extension 80 extends over an arc-length S defined by an angle $\beta$. The angle $\beta$ has a preferred amount of $150° \leq \beta \leq 240°$.

In drive-in direction R of the functional end 70 into the wire thread insert 1, the front end of the length-reduced first turn 72 and thus also the front end of the extension 80 comprises a driving edge 82. The driving edge 82 extends preferably parallel to the longitudinal axis of the mounting spindle 62. The course of the driving edge 82 can also differ from this orientation as long as the functional cooperation between moving notch 42 and driving edge 82 is ensured. In case the functional end 70 is screwed in drive-in direction R into the wire thread insert 1 with moving notch 42 (step S1), the driving edge 82 enters independently into the moving notch 42 (step S2). At this, the driving edge 82 engages the undercut 43 so that a rotation-proof connection between mounting spindle 62 and wire thread insert 1 is created in drive-in direction R. The rotation-proof connection ensures that the wire thread insert 1 is rotated by means of a rotation of the mounting spindle 62 as well and can be installed in an inner thread of a component opening of the component in this way. Preferably, the driving edge 82 is arranged radially inwardly displaced with respect to a core radius $r_K$ of the length reduced first turn 72*a*. The core radius $r_K$ is shown in FIGS. 4 and 5. It is defined by the distance between the central axis of the mounting spindle 62 and the radial outer edge of the thread core or the bottom of the turn 72*a*, 72*b*. Preferably, the driving edge 82 is spaced by the length $l_{MK}$ from the central axis of the installation spindle 62. The length $l_{MK}$ comprises preferably a range of $r_K > l_{MK} \geq 1.4\ r_K$ to ensure an ideal cooperation of the moving notch 42 and the driving edge 82.

As soon as the driving edge 82 engages the moving notch 42 of the wire thread insert 1, the mounting spindle 62 rotates the wire thread insert 1 as well. During this screwing-in or driving-in of the wire thread insert 1 into a component opening (step S3) the driving edge 82 drags the wire thread insert 1 in drive-in direction R due to the rotation-proof engagement at the undercut 43. At this, the first winding 32 which follows the driving tang 50 engages at the length-reduced first turn 72*a* and forms with it an additional frictional connection. This frictional connection supports the transfer of the installing torque from the mounting spindle 62 to the wire thread insert 1. Because the torque for installing and to be transferred to the wire thread insert 1 is distributed thereby to the driving edge 82 and the length-reduced first turn 72*a*. Therefore, it is preferred to adjust the length of the length-reduced first turn 72*a* (see angle $\beta$, above) depending on the torque to be transferred. From this it follows that at a higher torque to be transferred between installation spindle 62 and wire thread insert 1, the length-reduced first turn 72*a* has to be formed longer compared to a smaller torque to be transferred.

Preferably, the driving edge 82 is formed by a radially inner and radially outer leg. These two legs enclose an angle of <90°, preferably <50° and further preferred <40°. It is also preferred that the length-reduced first turn 72*a* extends into an axial web which forms due to its width the driving edge 82.

The length-reduced first turn 72*a* extends at its end facing away from the screw-in or drive-in direction R into a bend-up shoulder. The bend-up shoulder 84 consists of a face which is oriented straight angularly with respect to the core radius $r_K$ (not shown) or of a curvilinear face. The bend-up shoulder 84 forms an axial boundary face 85 of the extension 80. Preferably the bend-up shoulder 84 encloses with the outer edge of the mounting spindle 62 an angle $\delta < 90°$, preferably $90° > \delta > 30°$. If the bend-up shoulder 84 consists of a curvilinear face, the angle $\delta$ is measured between the tangent $T_\delta$ at the face 85 at the intersection with the outer edge of the mounting spindle 62 and the outer edge of the mounting spindle 62 (see FIGS. 4 and 5). Further preferred, the bend-up shoulder 84 is formed curvilinear. The curvilinear formed bend-up shoulder 84 comprises with respect to the installation spindle 62 in the course radially inwardly an increasing curvature.

According to a further preferred embodiment, the bend-up shoulder 84 is integrally connected via the length-reduced turn 72*a* and directly to the driving edge 82. In this way, the extension 85 is formed stable and forms an additional radial support for the length reduced first turn 72*a*.

After the wire thread insert 1 has been screwed into the component opening with thread to a sufficient depth, the mounting spindle 62 is rotated against the screw-in or drive-in direction R (step S4). At this, the engagement of the driving edge 82 is released from the moving notch 42. Upon further rotating of the mounting spindle 62 and thus of the functional end 72, the bend-up shoulder 84 comes into abutment with the driving tang 50. By means of the further rotating of the functional end 70 against the drive-in direction R, the bend-up shoulder 84 presses the driving tang 50 radially outwardly into the circumferential contour of the wire thread insert 1. At this, the driving tang 50 slides on the axial face 85 of the bend-up shoulder 84. During the redressing of the driving tang 50 (step S5) the bending portion 40 is mechanically stressed such that the driving tang 50 is redressed permanently into the circumferential contour of the wire thread insert 1. Thus, at de-spindling or screwing the mounting spindle 62 out of the wire thread insert 1, the bend-up shoulder 84 bends the driving tang 50 which is weakened by the moving notch 42 radially into the inner thread of the component opening. The driving tang 50 is thus bent radially to the outside permanently and beyond the enclosing contour of a screw and a thread plug gauge. The drive-in torque of a screw into the wire thread insert 1 with redressed driving tang 50 is almost zero. The accuracy to gauge of the wire thread insert 1 with redressed tang 50 achieved in this way means that the redressed tang 50 does not interfere with the thread provided by the wire thread insert 1. The evidence for such an accuracy to gauge takes place according to tolerance class 6H, based on which the plug gauge is manually screwed into the installed wire thread insert 1 with redressed tang 50 (see also ISO standard 965-1).

A preferred embodiment of the second alternative of the installation tool is schematically shown in FIG. 6. In contrast to the first alternative of the installation tool, it has another functional end 70'. The preferred functional end 70' comprises a first 90 and a second threaded portion 92 which are arranged adjacent to the free end of the functional end 70' opposite to the driving end 64. Preferably, both threaded portions 90, 92 are arranged directly adjacent to each other to ensure a frictionless transfer of the wire thread insert 1 between the threaded portions 90, 92 at the screwing-on and screwing-off from the functional end 70'. It is also preferred to arrange the two threaded portions 90, 92 axially spaced from each other on the functional end 70'.

In the second threaded portion 92, a thread fitting to the shape of the wire coil of the wire thread insert 1 is provided. This thread of the second threaded portion 92 has the same characteristics as the turn 72*b* of the functional end 70 (see above). By means of the shape and dimension of the thread adapted to the wire thread insert 1, the wire thread insert 1 can enter without problems into the second threaded portion 92. The second threaded portion 92 can be characterized by a core radius $r_{K2}$, as shown in FIG. 7. The core radius $r_{K2}$ defines the distance between the longitudinal axis of the functional end 70' and the radial outer side of the threaded core of the second threaded portion 92.

As can be seen based on FIGS. 7 and 8, a thread core of the first threaded portion 90 is larger as the thread core of the second threaded portion 92. Especially, the core radius $r_{K1}$ of the first threaded portion 90 is larger as the core radius $r_{K2}$ of the second threaded portion 92. Preferably, the core radius $r_{K1}$ is larger as the core radius $r_{K2}$ by the factor F so that it applies $r_{K1}=F\ r_{K2}$. The factor F varies preferably in a range of $1/1000 \leq F \leq 5/100$, further preferred in the range $1/100 \leq F \leq 3/100$ and at most preferred in the range of $2/1000 \leq F \leq 2/100$. Correspondingly it results that the first core diameter $2r_{K1}$ is at least 0.1% larger as the second core diameter $2r_{K2}$, preferably in a range of 0.1% to 2% larger as the first core diameter $2r_{K1}$.

The first threaded portion 90 or the turn of the first threaded portion 90 extends at least over a rotation angle $\omega \geq 180°$ around the longitudinal axis of the mounting spindle 62. Corresponding to the rotation direction of the first threaded portion 90, this angle $\omega$ is measured clockwise or counterclockwise. Preferably, the first threaded portion 90 extends over a rotation angle in the range of $180° \leq \omega \leq 720°$.

The second threaded portion 92 comprises a radial recess 94 in which the moving notch 42 with undercut 43 engages. As the driving tang 50 is bent radially inwardly, the moving notch 42 locks due to its inherent coil tension into the recess 94 upon spindling of the wire thread insert 1 onto the functional end 70'. As the recess 94 is preferably chamfered, a rotation-proof connection results in screw-in or drive-in direction R between the functional end 70' and the wire thread insert 1.

The radial recess 94 is preferably formed as bore, cut or electric discharge machining. Further, it is preferred to extend the recess 94 along the turn of the second threaded portion 92 over a certain length. This length corresponds according to an embodiment of the present invention to the length of the driving tang 50 so that it may be retained more easily in a rotation-proof manner in the recess 94.

While the recess 94 is preferably arranged in the second threaded portion 92, it could also be arranged in the first threaded portion 90.

For installing the wire thread insert 1 in a component opening with inner thread, the wire thread insert 1 is spindled or screwed onto the functional end 70'. This occurs manually or mechanically. As the wire thread insert 1 may expand radially during the spindling because it is not limited by a component wall, the wire thread insert 1 is spindled without a specific mechanical effort onto the first 90 and the second threaded portion 92 (step S1). At the end of the spindling, the driving tang 50 and/or the moving notch 42 engage in a rotation-proof manner with the recess 94 and thus with the functional end 70' (step S2).

Subsequently, the wire thread insert is screwed into the desired depth of the inner thread of the component opening by means of the mounting spindle 62 (step S3). For de-spindling the wire thread insert 1 from the mounting spindle 62, the mounting spindle 62 is rotated against the drive-in direction R (step S3). At this, first of all the second threaded portion 92 and then the first threaded portion 90 is screwed out of the wire thread insert 1, wherein the first threaded portion 90 passes through the complete wire thread insert 1.

During the screwing out or de-spindling (step S4), first of all the moving notch 42 is pressed radially out of the recess 94. As soon as the first threaded portion 90 reaches the driving tang 50, the larger core radius $r_{K1}$ urges the driving tang 50 radially to the outside such that it is redressed permanently into the inner thread of the component opening or the circumferential contour of the wire thread insert 1 (step S5). As preferably the moving notch 42 presents a weakening of the bending portion 40 of the wire thread insert 1, it supports the redressing of the driving tang 50.

Due to the enlarged core diameter or core radius $r_{K1}$ of the first threaded portion 90, the driving tang 50 receives beside the radially outwardly directed bending force an additional tangential application of force by means of the friction of the driving tang 50 at the radially outer side of the two threaded portions 90, 92, especially by the threaded portion 90. Due to this friction-caused additional application of force, preferably in the bending portion 40, a multi-axial mechanical tension condition is achieved. This causes an exceeding of the material yield strength in the bending portion 40 so that a permanently radial redressing of the driving tang 50 is realizable. Due to this, the driving tang 50 can be bent radially to the outside permanently beyond the enclosing contour of a screw and a thread plug gauge and can be calibrated there. The drive-in torque for such a redressed driving tang 50 and the wire thread insert 1 arranged thereby in the component opening is almost zero. The evidence of this accuracy to gauge is performed preferably by screwing in a plug gauge with manual force according to tolerance class 6H (see also ISO standard 965-1).

The individual steps of the installation method for the wire thread insert 1 in the component opening are schematically summarized according to a preferred embodiment in the flowchart of FIG. 9.

LIST OF REFERENCE SIGNS

1 wire thread insert
20 coil
22 first end
23 second end

30 winding
40 bending portion
42 moving notch
43 undercut
50 driving tang
60; 60' installation tool
62 mounting spindle
70; 70' functional end
72 threaded section
72*a* first length reduced turn
72 second turn
73 aperture
74 receiving portion
80 front-end extension
82 driving edge
84 bend-up-shoulder
85 axial boundary face of the bend-up-shoulder
90 first threaded portion
92 second threaded portion
94 recess
$r_{K1}$, $r_{K2}$ core radius
R drive-in direction of the mounting spindle into the wire thread insert
B fastening direction of the wire thread insert onto the functional end
S arc length
$r_K$ core radius
α angle in the wire thread insert
β angle of the length reduced first threaded portion 72*a*
γ angle of the aperture 73

The invention claimed is:

1. An installation tool for a wire thread insert having a cylindrical coil with a plurality of helically wound windings of a wire, in which a first winding comprises a driving tang with a moving notch protruding into an interior of the coil via a bending portion, wherein the installation tool comprises the following features:

a) a rotatable mounting spindle with a driving end for rotating the mounting spindle and a functional end for installation of the wire thread insert, wherein b) the functional end comprises at least one turn which is reduced in length in a circumferential direction and which has a driving edge at a first end for engagement into the moving notch of the wire thread insert and a bend-up-shoulder at a second end for bending the driving tang of the wire thread insert radially outwardly; and c) in which the bend-up shoulder is connected integrally and directly to the driving edge by means of the length-reduced turn.

2. The installation tool according to claim 1, in which the at least one length-reduced turn has a length in the circumferential direction which extends over a rotation angle of ≤270° around a longitudinal axis of the mounting spindle.

3. The installation tool according to claim 2, in which the driving edge is formed by a radial inner leg and a radial outer leg which enclose an angle <90°.

4. The installation tool according to claim 3, in which the bend-up-shoulder comprises a web inclined radially inwardly and opposite to a drive-in direction of the mounting spindle which encloses with a radial outer edge of the mounting spindle an angle δ<90°.

5. The installation tool according to claim 4, in which the bend-up-shoulder has a curvilinear form including an increasing curvature in its course radially inwardly with respect to the installation spindle.

6. The installation tool according to claim 1, in which the driving edge is formed by a radial inner leg and a radial outer leg which enclose an angle <90°.

7. The installation tool according to claim 6, in which the bend-up-shoulder comprises a web inclined radially inwardly and opposite to a drive-in direction of the mounting spindle which encloses with a radial outer edge of the mounting spindle an angle δ<90°.

8. The installation tool according to claim 7, in which the bend-up-shoulder has a curvilinear form having an increasing curvature in its course radially inwardly with respect to the installation spindle.

9. An installation method of a wire thread insert with a redressable, non-removable driving tang and a moving notch by means of an installation tool according to claim 1 in a receiving thread of a component, said method comprising the following steps:

a) spindling or plugging the wire thread insert onto a functional end of a mounting spindle of the installation tool such that the moving notch couples in a form-fit manner to a driving edge or a radial recess of the installation tool and connects the wire thread insert rotation-proof with the installation tool, b) screwing-in of the wire thread insert into the receiving thread by rotating the mounting spindle in a first rotation direction, c) redressing the driving tang into the receiving thread by rotating the mounting spindle in a second rotation direction, and d) de-spindling or removing the mounting spindle from the wire thread insert with the redressed driving tang.

10. The installation method according to claim 9, which further comprises:

radially redressing the driving tang by means of the bend-up-shoulder or a second threaded portion with an enlarged core diameter compared to a first threaded portion at the functional end of the mounting spindle.

* * * * *